US006989660B2

(12) United States Patent
Mauthe

(10) Patent No.: US 6,989,660 B2
(45) Date of Patent: Jan. 24, 2006

(54) CIRCUIT ARRANGEMENT FOR VOLTAGE REGULATION

(75) Inventor: Manfred Mauthe, Grosshelfendorf (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/958,822

(22) Filed: Oct. 5, 2004

(65) Prior Publication Data

US 2005/0110477 A1 May 26, 2005

Related U.S. Application Data

(63) Continuation of application No. PCT/DE03/00860, filed on Mar. 17, 2003.

(30) Foreign Application Priority Data

Apr. 5, 2002 (DE) ..... 102 15 084

(51) Int. Cl.
*G05F 1/44* (2006.01)
*G05F 1/56* (2006.01)

(52) U.S. Cl. ..... 323/274; 323/275; 323/284; 323/285

(58) Field of Classification Search ..... 323/273, 323/274, 275, 282, 284, 285
See application file for complete search history.

(56) References Cited

U.S. PATENT DOCUMENTS 4,622,511 A * 11/1986 Moore ..... 323/282
5,412,308 A * 5/1995 Brown ..... 323/267
5,528,129 A 6/1996 Kaneko et al.
5,629,609 A * 5/1997 Nguyen et al. ..... 323/269
5,864,225 A * 1/1999 Bryson ..... 323/268
5,991,168 A * 11/1999 Farrington et al. ..... 363/16

FOREIGN PATENT DOCUMENTS

EP 0 376 655 A1 7/1990

OTHER PUBLICATIONS

"The Design of an Automotive Low Drop Out Regulator IC Utilizing a Depletion Mode High Voltage DMOS Pass Element", Robert Wrathall and Stephen Franck, Power Electronics in Transportation, Oct. 20-21, 1994, pp. 17-22.
"A High-Speed, Low-Power Clock Generator for a Microprocessor Application", Vincent R. Von Kaenel, IEEE Journal of Solic-State, vol. 33, No. 11, Nov., 1998, pp. 1634-1639.
"Embedded 5 V-to-3.3 V Voltage Regulator for Supplying Digital IC's in 3.3 V CMOS Technology", Gerrit W. Den Beston and Bram Nauta, IEEE Journal of Solid-State Circuits, vol. 33, No. 7, Jul., 1998, pp. 956-962.

* cited by examiner

*Primary Examiner*—Bao Q. Vu
(74) *Attorney, Agent, or Firm*—Eschweiler & Associates, LLC

(57) ABSTRACT

The invention specifies a circuit arrangement for voltage regulation in which, in addition to a control loop having a comparator (4), an output stage (3) and a feedback path, an auxiliary regulator (11–14) is provided which limits the voltage drop across the output stage (3) and, for this purpose, comprises a control element (11) and a further comparator (13). Hence, the output stage (3) of the voltage regulator may advantageously have a withstand voltage which is lower than the supply voltage which can be supplied at the input (1). On account of its good supply voltage suppression, the voltage regulator described is particularly well suited to supplying on-chip VCOs.

19 Claims, 4 Drawing Sheets

CIRCUIT ARRANGEMENT FOR VOLTAGE REGULATION

REFERENCE TO RELATED APPLICATIONS

This application is a continuation of PCT/DE03/00860, which was not published in English, filed on Mar. 17, 2003, that claims the benefit of the priority date of German Patent Application No. DE 102 15 084.5, filed on Apr. 5, 2002, the contents of which are both herein incorporated by reference in their entirety.

FIELD OF THE INVENTION

The present invention relates to a circuit arrangement for voltage regulation.

BACKGROUND OF THE INVENTION

Ever larger scales of integration in integrated circuits are normally accompanied by a constant decrease in the supply voltage for the integrated circuits. In this context, certain integration technologies may use semiconductor components with different supply voltages. By way of example, CMOS (Complementary Metal Oxide Semiconductor) production techniques use transistors for designing analog circuits, particularly for forming interfaces for the integrated circuit, with a comparatively high withstand voltage in addition to transistors which are suitable for designing digital circuits and have a significantly lower withstand voltage.

In order to supply integrated circuits, which need various supply voltages internally, with just one external supply voltage, there is normally an "on-chip" voltage regulator, which is usually in the form of a continuously operating linear regulator. In this case, such voltage regulators should be able to manage without external inductances or capacitances.

Particularly when actuating resonant circuits, for example in order to generate radio-frequency carrier signals, a voltage regulator whose output voltage has good supply voltage suppression (Power Supply Rejection Ratio, PSRR) and at the same time has low inherent noise is desired in order to supply the voltage controlled oscillators which are normally provided in that case, so as not to impair the phase noise in the oscillator which is to be powered.

The document V. R. von KAENEL, A high-speed, low-power clock generator for a microprocessor application, IEEE Journal of Solid-State Circuits, Vol. 33, No. 11, November 1998 specifies a phase locked loop in a clock generator, which phase locked loop shows a generalized illustration of a voltage regulator using a circuit diagram, cf. FIG. 2 therein.

The paper G. W. Den Besten, B. Nauta, Embedded 5 V-to-3.3 V Voltage Regulator for Supplying Digital ICs in 3.3 Volt CMOS Technology, IEEE Journal of Solid-State Circuits, Vol. 33, No. 7, July 1998 specifies a voltage regulator for converting an input voltage of 5 volts into an output voltage of 3.3 volts in CMOS circuitry. FIGS. 2*a* and 2*b* show ordinary voltage regulators which use either a P-channel MOS transistor, cf. FIG. 2*a*, or an N-channel MOS transistor, cf. FIG. 2*b*, as regulating transistor. The gate connection of the regulating transistor is respectively actuated by a difference amplifier, to which firstly a reference voltage, which is provided by a bandgap circuit, for example, and secondly a signal derived from the regulator's output voltage are supplied. Although the circuit variant with the PMOS transistor provides a large voltage control range, it has the drawback of inadequate supply voltage suppression at frequencies above the amplifier bandwidth. Although the regulator circuit with the NMOS transistor exhibits good PSRR properties, it has a relatively low achievable output voltage.

If the regulating transistor in a circuit in line with FIG. 2*a* or 2*b* in the latter document is equipped with a withstand voltage which is lower than the input voltage of the voltage regulator, then, particularly in the case of a resistive-capacitive load mixture, turning on the voltage regulator may result in a voltage drop across the regulating transistor which is larger than its admissible voltage. If the difference amplifier used, which actuates the regulating transistor, is a bandgap voltage source, whose voltage first needs to build up starting at 0 volt, then even the full input voltage is applied across the regulating transistor at the instant-of turning on.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present one or more concepts of the invention in a simplified form as a prelude to the more detailed description that is presented later.

The present invention provides a circuit arrangement for voltage regulation which is integratable and in which a regulating transistor used may be a transistor whose withstand voltage is lower than the input voltage which powers the voltage regulator.

A circuit arrangement for voltage regulation in accordance with an aspect of the present invention includes:

an input connection for supplying a supply voltage, an output connection for tapping off an output voltage, an output stage which comprises a control input and a controlled path having a first and a second load connection, the first load connection being coupled to the input connection of the circuit arrangement, and the second load connection being connected to the output connection of the circuit arrangement and being coupled to a reference potential connection via an electrical load, a reference generator which provides a reference potential at its output, a comparator which comprises a first input, which is connected to the reference generator, and which comprises a second input, which is coupled to the output connection of the circuit arrangement, for regulating the output voltage, and, an auxiliary regulator for limiting the voltage drop across the output stage, comprising a control element which is connected firstly to the input connection and secondly to the controlled path of the output stage at a circuit node and comprising a further comparator having a nominal value input, which is coupled to the control input of the output stage, and having an actual value input, which is coupled to the circuit node.

The auxiliary regulator is used, particularly at the moment at which the voltage regulator is turned on, to limit the voltage drop across the output stage to an admissible level. It is thus possible for the output stage to be advantageously produced with semiconductor components whose withstand voltage is lower than the supply voltage which can be supplied at the input connection.

This is based on the present principle of the auxiliary regulator limiting the voltage between the circuit node at one of the load connections of the controlled path of the output stage and the control input of the output stage to a maximum voltage magnitude, for example 0.5 volt. However, as soon as the voltage at the control input of the output stage exceeds a particular value, the control element forms a closed switch between the input connection and the circuit node on the controlled path of the output stage, so that the output stage's control range is not reduced during normal operation.

To actuate the control element in the auxiliary regulator using the further comparator, there is a voltage source, such as a "floating battery", which is connected between one of the inputs of the further comparator in the auxiliary regulator and the control input of the output stage in the circuit arrangement.

This thus causes the potential on the nominal value input of the further comparator in the auxiliary regulator to be higher than the potential on the control input of the output stage by a definable voltage magnitude. This sets the voltage on the voltage node of the circuit arrangement such that it is fundamentally the same as the sum of the voltage on the control input of the output stage and the floating battery voltage. In this context, in line with the present principle, the restriction applies that the auxiliary regulator is automatically used to limit the voltage on the circuit node to the supply voltage as soon as the voltage on the control input of the output stage exceeds that voltage value which is obtained from the difference between the supply voltage and the fixed voltage magnitude provided by the floating battery. In this case, the auxiliary regulator represents a short circuit, that is to say a closed switch, for its output stage.

In line with another aspect of the present invention, an output stage and/or a control element in the auxiliary regulator are respectively in the form of MOS transistors.

In this case, the MOS transistor in the output stage is preferably provided as a MOS transistor which is designed for a low withstand voltage and a regular threshold voltage. The MOS transistor in the auxiliary regulator's control element is preferably in the form of a transistor in which the conductivity type of the channel is complementary to that of the output stage, but has a higher withstand voltage than the transistor in the output stage. In this context, the gate connection respectively represents the control input of the control element or output stage, while the source and drain connections of the MOS transistors respectively represent the connections of the controlled paths.

To form the feedback signal which is derived from the output voltage and is supplied to the comparator which actuates the output stage, a suitable/circuit component, such as a voltage divider, is employed. The design of this is dependent firstly on the desired output voltage and secondly on the voltage which the reference generator delivers at its output. In the case of bandgap reference sources produced in silicon technology, this bandgap voltage is normally 1.2 volts.

The circuit arrangement's comparator, which actuates the output stage of the regulator, and the further comparator in the auxiliary regulator are respectively in the form of differential amplifier or operational amplifier, which respectively comprise an inverting input and a noninverting input.

In this case, that differential amplifier which actuates the output stage is advantageously preferably designed such that its output signal can be controlled up to the positive supply voltage.

A further improvement in the suppression of disturbances on the supply voltage can be achieved by developing the circuit arrangement with a further control loop which supplies the reference generator.

This involves forming a further control loop which comprises a control element, a comparator and a feedback path from the control element to the comparator via a voltage divider. In this case, an output on the control element is coupled to a supply connection on the reference generator. Advantageously, this additional auxiliary voltage can also supply the floating battery, and also the comparator which actuates the output stage and the further comparator, which is provided in the auxiliary regulator.

In this case, there is a switch which can change over the voltage to be supplied to the reference generator for the purpose of powering it between the actual supply voltage for the regulating circuit and the auxiliary voltage generated.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The invention is explained in more detail below using a plurality of exemplary embodiments with reference to the drawing, in which.

DETAILED DESCRIPTION OF THE INVENTION

The present invention will now be described with respect to the accompanying drawings in which like numbered elements represent like parts. The figures provided herewith and the accompanying description of the figures are merely provided for illustrative purposes. One of ordinary skill in the art should realize, based on the instant description, other implementations and methods for fabricating the devices and structures illustrated in the figures and in the following description.

Figure 1:
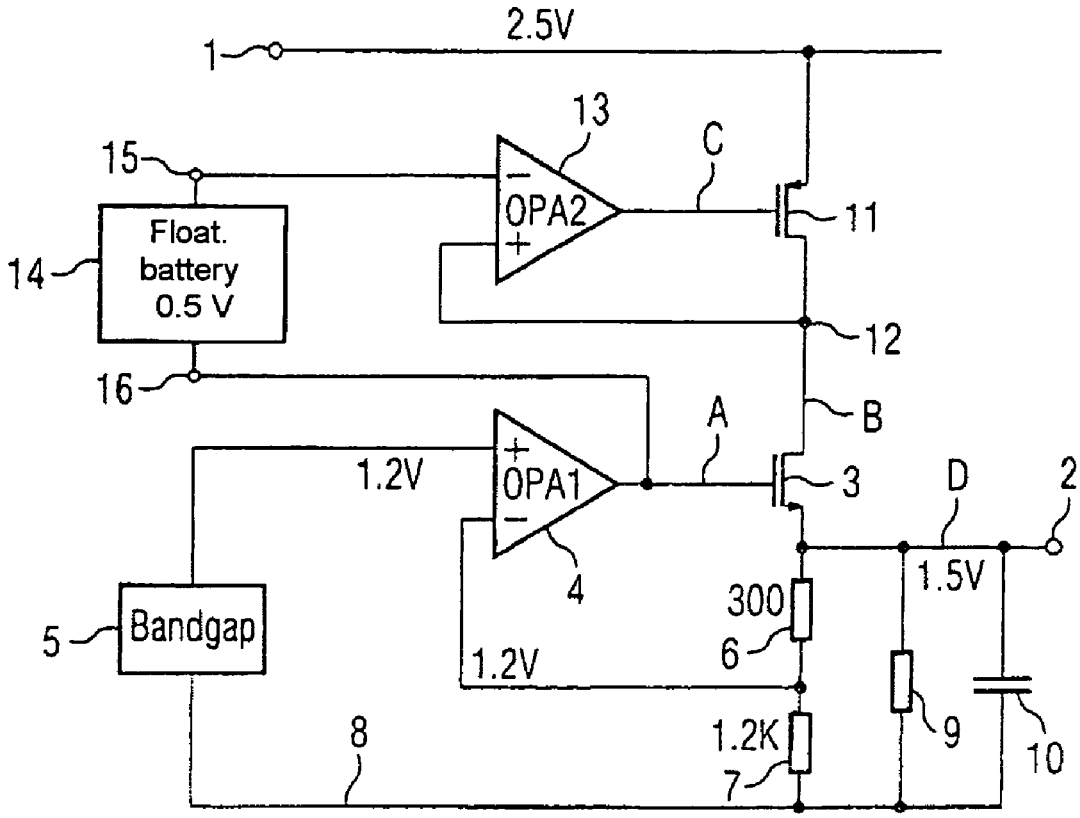
FIG. 1 shows a simplified circuit diagram in accordance with an aspect of the present invention.

FIG. 1 shows a circuit arrangement for voltage regulation with an input connection 1 for supplying a supply voltage of 2.5 volts and an output connection 2 for tapping off a regulated output voltage of 1.5 volts in accordance with an aspect of the present invention. The output stage provided is an N-channel MOS field effect transistor 3 having a gate connection, a source connection and a drain connection. The source connection of the output stage 3 forms the output connection 2 of the circuit. The gate connection is connected to the output of a differential amplifier 4, which operates as a comparator and has an inverting input and a noninverting input. The noninverting input of the comparator 4 is connected to the output of a bandgap reference generator 5 which provides a bandgap voltage of 1.2 volts. The output 2 of the circuit is connected to the inverting input of the comparator 4 via a voltage divider 6, 7, comprising a series circuit made up of a 300 ohm resistor 6 and a 1.2 kilo ohm resistor 7, and is also coupled to a reference potential connection 8 to which the bandgap generator 5 is also connected. Connected between the output connection 2 and the reference potential connection 8 of the regulating circuit shown in FIG. 1 there are also a resistor 9 and, in parallel therewith, a capacitance 10, which represent a resistive-capacitive load.

In line with the present principle, to protect the output stage 3 from the relatively high input voltage or supply voltage when the regulator is turned on, a further transistor 11 is provided which is in the form of a P-channel MOS field effect transistor and whose drain connection is connected to the drain connection of the output stage 3 at a circuit node 12 in the regulator. The source connection of the transistor 11 is connected to the input connection 1 of the regulator circuit. To form the auxiliary regulator, a further differential amplifier 13 is also provided, whose output is connected to the gate connection of the transistor 11 operating as a control element. The noninverting input of the further comparator 13 is connected to the circuit node 12, while the inverting input of the further comparator 13 operating as an operational amplifier is connected to the output of the comparator 4 via a floating battery 14. The connections of the floating battery have been provided with the reference symbols 15 and 16.

The floating battery raises the potential on the gate of the output stage 3 by 0.5 volt and supplies this voltage of increased potential to the inverting input of the comparator 13. While the withstand strength of the NMOS output transistor 3 is merely 1.5 volts, the PMOS transistor 11 has a withstand voltage of 2.5 volts.

The regulating transistor 3 operates as a source follower, where the source voltage follows the gate voltage. The auxiliary regulator, whose control element 11 is connected to the drain path of the regulating transistor 3, causes the drain connection 12 of the regulating transistor 3 to be no more than 0.5 volt above its gate voltage. This is done through the feedback actuation of the amplifier 13 and of the floating battery voltage of approximately 0.5 volt. The voltage on the circuit node 12 is set by means of the differential amplifier 13 such that it is essentially equal to the sum of the voltage on the gate connection of the transistor 3 and the floating battery voltage of 0.5 volt. In this case, however, the voltage on the circuit node 12 is automatically limited to 2.5 volts, namely to the supply voltage, as soon as the voltage on the gate of the transistor 3 exceeds the value 2 volts. This is because the transistor 11 represents a closed switch in this case.

The linear regulator described provides a significantly improved PSSR (Power Supply Rejection Ratio). While the regulator is turning on, that is to say while the regulating voltage is running up, the additional auxiliary regulator 11, 12, 13, 14 protects the output transistor 3, which has a withstand voltage of only 1.5 volts, from an overvoltage, which would otherwise be present immediately between its drain connection and its gate connection when it turns on.

In line with the principle described, the positive supply voltage for the NMOS regulating transistor 3 with a withstand voltage of 1.5 volts is held, during the turn-on operation, at a value which is no more than 0.5 volts above its gate voltage. This effectively prevents breakdown in the regulating transistor 3. In this case, although the relatively thin gate oxide layer and the relatively short channel of the transistor 3 result in a low withstand capability for its gate-source voltage of just 1.5 volts, they permit the desired, good PSSR, which, in particular, permits highly sensitive, voltage controlled oscillators to be supplied with voltage, such as are needed in resonance circuits, particularly in mobile radios.

Whereas the transistor 3 is a transistor having a conventional threshold voltage, the transistor 11 is designed for analog circuitry and has a corresponding threshold voltage.

The voltage source 14 may alternatively also be in the form of a level shifter circuit.

Figure 2:
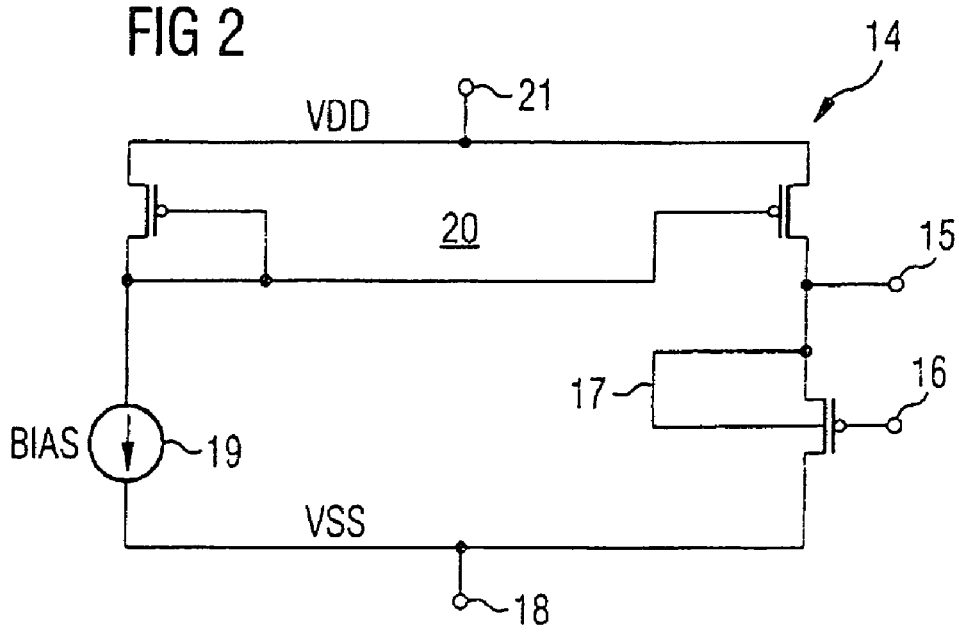
FIG. 2 uses a circuit diagram to show an exemplary embodiment of a fixed-value voltage source in line with FIG. 1 in accordance with an aspect of the present invention.

FIG. 2 shows the floating battery 14 from FIG. 1, whose output connection 15 provides a voltage which is always 0.5 volt above the voltage applied to its input 16 in accordance with another aspect of the invention. In this case, the output voltage from the voltage source 14 is precisely the magnitude of the threshold voltage of the PMOS transistor 17 above the input voltage on the node 16. In this arrangement, the gate connection of the transistor 17 is connected to the input 16, and its controlled path connects a reference potential connection 18 to the output connection 15. The transistor 17 is connected as a source follower and is powered by a BIAS current source 19, which is connected to the reference potential connection 18, via a current mirror 20. The current mirror 20 comprises two further PMOS transistors, whose gates are connected to one another and which are connected to the supply potential connection 21 of the voltage source 14 by a respective connection on their controlled paths. The input transistor of the current mirror 20 is connected to the diode in this arrangement.

In the present aspect, the transistor 17 has a threshold voltage of 0.5 volt. Threshold voltages for PMOS transistors in the range between 0.5 and 0.7 volt are usual.

Figure 3:
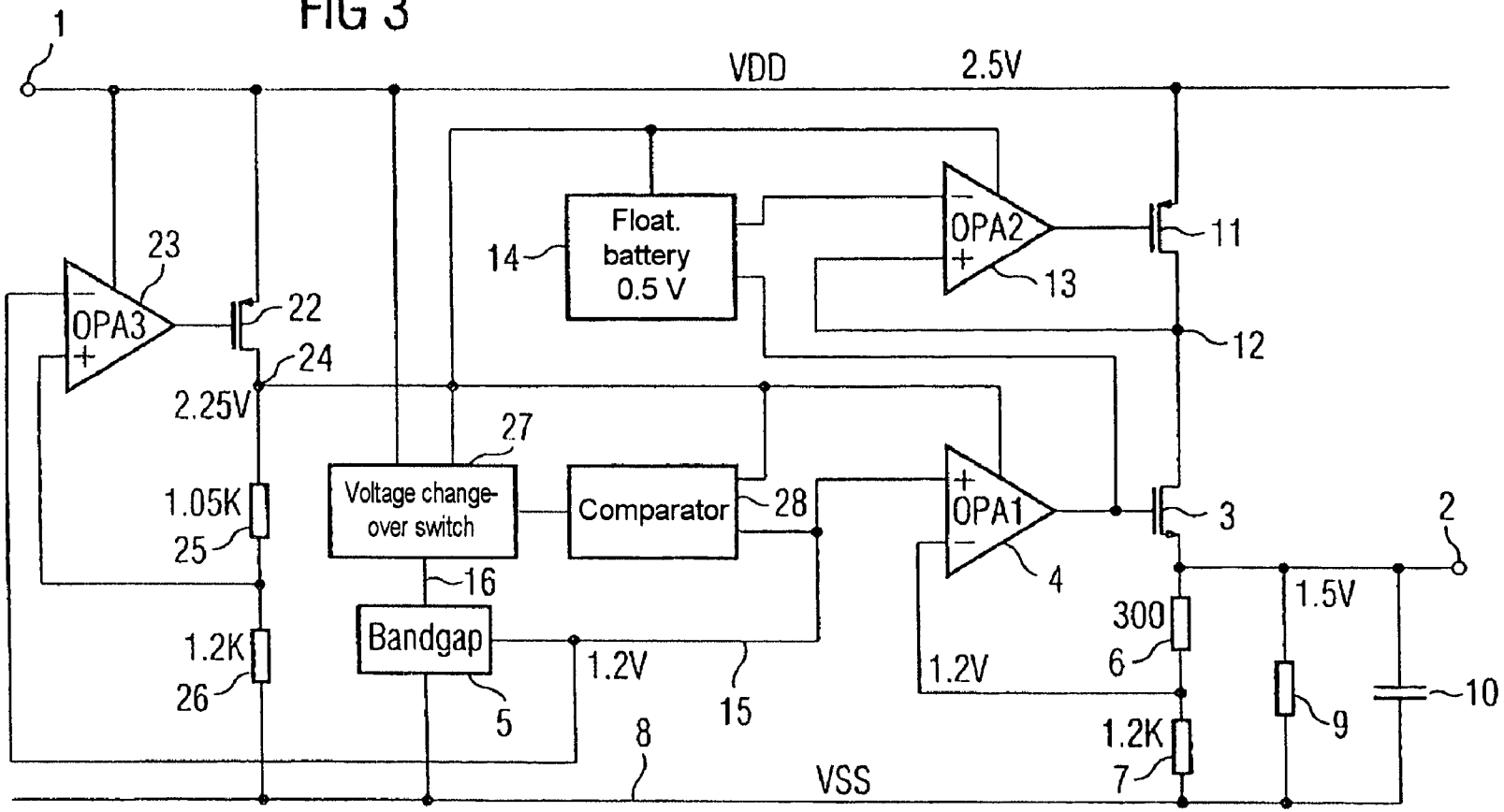
FIG. 3 shows a development of the voltage regulator from FIG. 1 with a further control loop in accordance with an aspect of the present invention.

FIG. 3 shows a development of the voltage regulator arrangement from FIG. 1 in accordance with yet another aspect of the present invention. This voltage regulator arrangement brings about a further improvement in the scatter of interference by virtue of an additional control loop which provides an additional, regulated supply voltage for the reference generator 5 and for the differential amplifiers 4, 13.

The design and advantageous action of the circuit shown in FIG. 3 largely correspond to those of the circuit shown in FIG. 1 and will therefore not be repeated at this juncture. The text below merely outlines the added components, their interconnection and the additional functionality with its advantages.

In line with FIG. 3, there is a further control loop with a control element, in the form of a transistor 22 of the P-channel type, having a control input and a controlled path, the control input, that is to say the gate connection of the transistor 22, being connected to the output of a comparator 23 which is in the form of a differential amplifier. The comparator 23 is connected to the input connection 1 in order to be supplied with voltage. The source connection of the control element transistor 22 is likewise connected to the input connection 1, while the drain connection forms the output 24 of the further control loop. At this output, a regulated voltage of 2.25 volts is provided. Connected between the output 24 of the further control loop and reference potential connection 8, to form a voltage divider, is a series circuit comprising a resistor 25 of 1.05 kilo ohms and a resistor 26 of 1.2 kilo ohms whose tap point is connected to the inverting input of the differential amplifier 23 for the purpose of tapping off a divided voltage. The noninverting input of the differential amplifier 23 is connected to the output connection 15 of the bandgap reference generator 5 in order to supply the bandgap voltage at the level of 1.2 volts constant. The output 24 of the further control loop for supplying the reference generator 5 with voltage is connected to a respective connection for supplying a supply voltage for the floating battery 14, for the differential amplifier 13 and for the differential amplifier 4. In addition, a changeover switch 27 is used to set up a connection to the input connection 16 of the reference generator 5. A further input on the changeover switch 27 is connected to the input connection 1 of the circuit for voltage regulation. The changeover switch 27 has, for the purpose of supplying a changeover command, a control input to which the output of a comparator 28 is connected. The comparator 28 has two inputs which are connected firstly to the output 24 of the further control loop and secondly to the output 15 of the reference generator 5.

The PMOS regulating transistor 22 is used to provide a regulated voltage having the highest possible voltage level. The comparator 28 in conjunction with the voltage changeover switch 27 make it possible for turning on the supply voltage on the connection 1 to involve this voltage first supplying the reference generator 5 and later, when the auxiliary voltage which can be tapped off at the output 24 has run up, being changed over to said auxiliary voltage. This means that the scatter of interference, particularly on the reference generator 5 and the amplifier 4, can be reduced further, so that the quality of the voltage which can be tapped off at the output connection 2, and which is regulated, is improved further.

Figure 4:
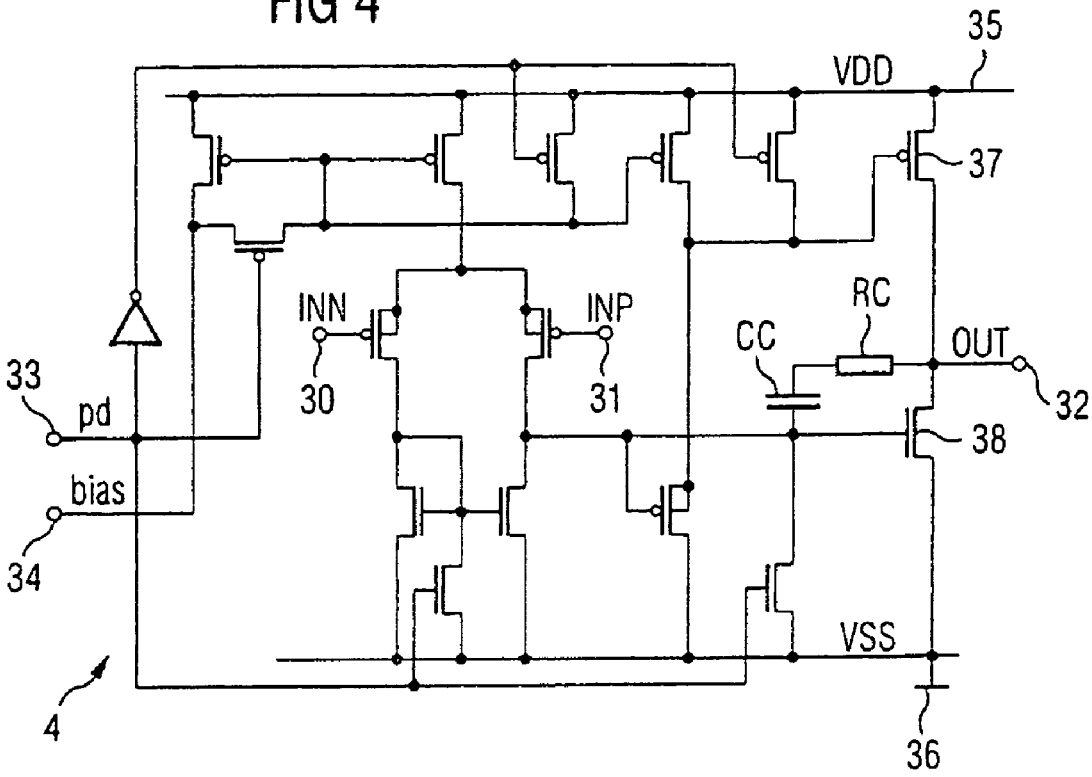
FIG. 4 shows an exemplary diagram of the operational amplifier shown in FIGS. 1 and 3 in CMOS circuitry in accordance with an aspect of the present invention.

FIG. 4 shows an exemplary two-stage operational amplifier designed using CMOS circuitry that can be employed in the arrangements shown in FIGS. 1 and 3 in accordance with an aspect of the present invention. In FIG. 1, the operational amplifiers 4 and 13, and, in FIG. 3, additionally, the operational amplifier 23, are in the form of two-stage operational amplifiers, as shown in FIG. 4.

The operational amplifier shown in FIG. 4 has an inverting input 30, a noninverting input 31 and an output 32. In addition, auxiliary inputs 33, 34 are provided. The operational amplifier is connected between a supply potential connection 35 and a reference potential connection 36. While a changeover command for putting the operational amplifier into a quiescent state (power down) can be supplied at the auxiliary input 33, a quiescent or biasing current (BIAS) can be supplied at the connection 34. The operational amplifier is designed as a differential amplifier and its output 32 provides a signal which is dependent on the voltage difference between the signals applied to the inputs 30, 31. The operational amplifier 34 is a two-stage design and is equipped with a Miller compensation element for stabilizing the frequency response.

Of significance for the operational amplifier shown in FIG. 4 when used in a circuit for voltage regulation as shown in FIGS. 1 and 3 is the fact that the signal which can be tapped off at the output 32 can be controlled almost up to the positive supply voltage which is supplied at the supply connection 35. In the two-stage operational amplifier, this is achieved by virtue of the two complementary output transistors 37, 38 in the output stage of the operational amplifier both being actuated using a signal which is dependent on the input difference voltage.

Figure 5:
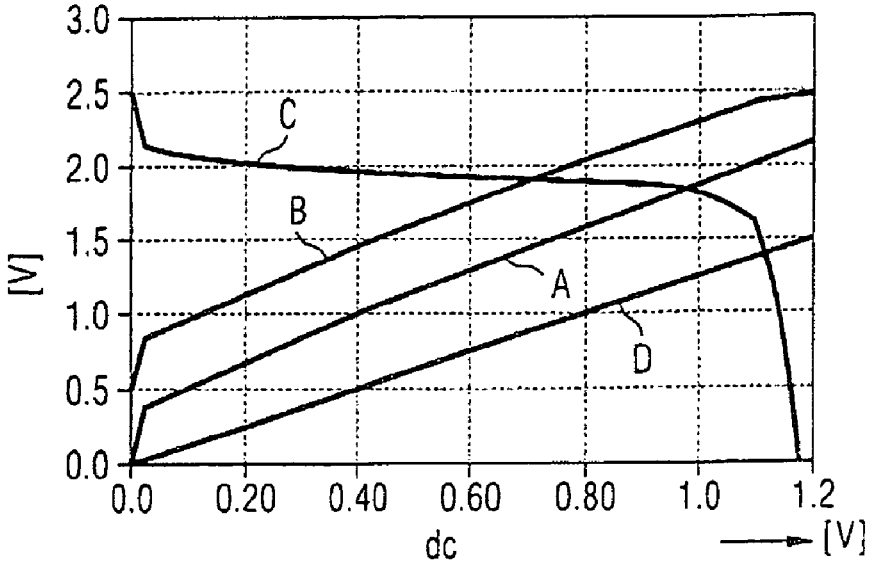
FIG. 5 uses a graphical representation to show the voltage profiles of selected node voltages in the circuit from FIG. 1 as a function of the supply voltage in accordance with an aspect of the present invention.

FIG. 5 uses a graphical representation to show a turn-on operation in the voltage regulator from FIG. 1. In this case, various voltage levels A, B, C, D are shown as a function of the bandgap voltage provided by the reference generator 5. This bandgap voltage has been run up from 0 volt to its rated value of 1.2 volts in the graphical representation in FIG. 5 for simulation purposes. The fundamentally constant voltage difference of approximately 0.5 volt between the level A at the input of the output stage and the level B at the circuit node 12 is clearly visible only when the supply voltage no longer allows this voltage difference does the signal level B remain constant, while the level C (which describes the voltage value at the control input of the control element 11 in the auxiliary regulator) changes to 0 volt. The full supply voltage is thus applied to the gate of the transistor. The curve D describes the regulated voltage at the output 2 of the circuit. The graphical representation shown in FIG. 5 accordingly makes use of the effective limitation of the voltage drop across the output stage 3.

Figure 6:
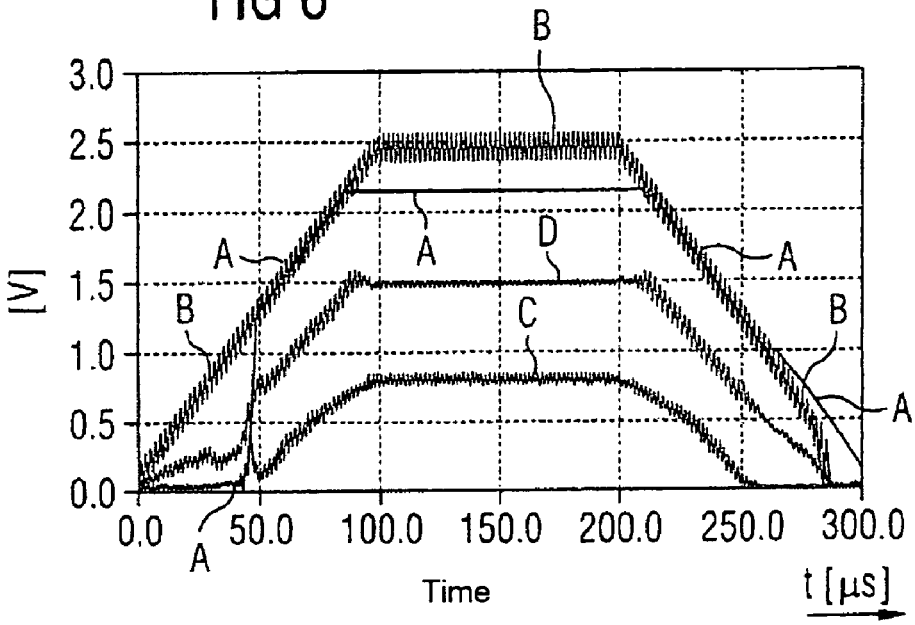
FIG. 6 shows the turn-on behaviour of the circuit from FIG. 1 with a disturbance overlaid on the supply voltage in accordance with an aspect of the present invention.

FIG. 6 shows the profile of the supply voltage from 0 volt up to 2.5 volts and back again over the time axis t for the circuit arrangement in FIG. 1. In this case, the supply voltage has interference overlaid on it with an amplitude of 100 mV. It can be seen that, for the regulated output voltage D, the value of this interference has been reduced to 1 mV. The graphical representation in FIG. 6 thus shows the good PSRR properties, that is to say the good suppression of interference on the supply voltage, which is brought about by the present principle of voltage regulation.

Figure 7:
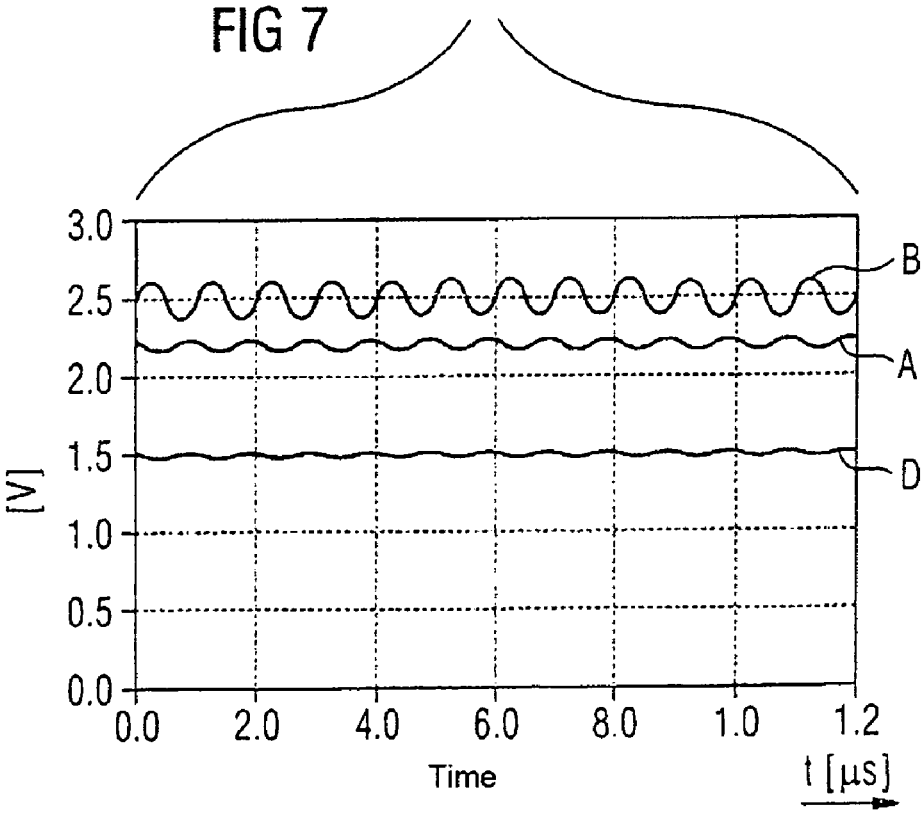
FIG. 7 shows an enlarged detailed illustration of the graphical representation from FIG. 6 in accordance with an aspect of the present invention.

This is further illustrated from the illustration in FIG. 7, which shows an enlargement of a detail from the graphical representation in FIG. 6 with higher resolution on the time axis.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

LIST OF REFERENCE SYMBOLS

1 Input connection
2 Output connection
3 Output stage
4 Comparator
5 Reference generator
6 Resistor
7 Resistor
9 Resistive load
10 Capacitive load
11 Control element
12 Circuit nodes
13 Further comparator
14 Fixed-value voltage source
15 Output
16 Input
17 Transistor
18 Reference potential connection

What is claimed is:

1. A circuit arrangement for voltage regulation comprising:

an input connection for supplying a supply voltage;

an output connection for tapping off an output voltage;

an output stage comprising a control input and a controlled path having a first and a second load connection, the first load connection being coupled to the input connection, and the second load connection being connected to the output connection and being coupled to a reference potential connection via an electrical load;

a reference generator, which provides the reference potential at its output;

a comparator, which comprises a first input connected to the reference generator a second input coupled to the output connection for regulating the output voltage; and an auxiliary regulator for limiting the voltage drop across the output stage, comprising a control element that couples the input connection to the controlled path of the output stage at a circuit node and comprising a further comparator having a nominal value input, which is coupled to the control input of the output stage, and having an actual value input, which is coupled to the circuit node.

2. The circuit arrangement of claim 1, further comprising a zero-potential fixed-value voltage source that generates the nominal value.

3. The circuit arrangement of claim 2, wherein the zero-potential fixed-value voltage source is in the form of a floating battery.

4. The circuit arrangement of claim 1, wherein the output stage comprises a MOS transistor.

5. The circuit arrangement of claim 1, wherein the control element in the auxiliary regulator is in the form of a MOS transistor.

6. The circuit arrangement of claim 1, further comprising a voltage divider that couples the output connection to the second input of the comparator.

7. The circuit arrangement of claim 1, wherein the comparator in the circuit arrangement and the further comparator in the auxiliary regulator are respectively in the form of an operational amplifier.

8. The circuit arrangement of claim 1, further comprising a control loop for supplying voltage to the reference generator, said control loop comprising:

a control element having a control input and a controlled path which connects the input connection of the circuit arrangement to an output on the control loop and couples said input connection to a supply connection on the reference generator; and a comparator having a first input coupled to the output of the reference generator, having a second input coupled to the output of the control element, and having an output which is connected to an input of the reference generator.

9. The circuit arrangement of claim 8, further comprising a changeover switch having a first input connected to the input connection of the circuit arrangement, having a second input connected to the output of the control element, and having an output which is connected to the input of the reference generator.

10. The circuit arrangement of claim 9, further comprising a comparator, having a first input connected to the output of the control element, having a second input connected to the output of the reference generator, and having an output connected to a control input on the changeover switch for the purpose of executing a changeover command.

11. A circuit arrangement for voltage regulation comprising:

an output stage that generates a regulated output voltage;

a control component coupled to the output stage that at least partially controls generation of the regulated output voltage;

a bandgap reference generator coupled to the control component that provides a bandgap voltage; and an auxiliary regulator coupled to the output stage that limits a voltage drop across the output stage, wherein the auxiliary regulator comprises a regulator control component coupled to the output stage that at least partially controls generation of the regulated output voltage, and wherein the regulator control component further comprises a fixed voltage source coupled to the regulator control component and the output stage, thus limiting a voltage drop across the output stage.

12. A circuit arrangement for voltage regulation comprising:

an output transistor having a gate connection, a source connection, and a drain connection, wherein the source connection provides a regulated output voltage;

a first differential amplifier having an inverting input, a non-inverting input, and an output, wherein the output is connected to the gate connection of the output transistor;

a bandgap reference generator having a first terminal connected to the non-inverting input of the differential amplifier and a second terminal, wherein a bandgap voltage is supplied to the second terminal;

a voltage divider circuit having a first terminal, a second terminal, and a third terminal, wherein the second terminal generates a fraction of a voltage supplied at the first terminal, wherein the third terminal is connected to the second terminal of the bandgap reference generator, wherein the second terminal is connected to the inverting input of the first differential amplifier; and wherein the first terminal is connected to the source connection of the output transistor;

a regulating transistor having a gate connection, a source connection, and a drain connection, wherein the source connection receives a supply voltage and wherein the drain connection is connected to a drain connection of the output transistor;

a second differential amplifier having an inverting input, a non-inverting input, and an output, wherein the output is connected to the gate connection of the regulating transistor and wherein the non-inverting input is connected to the drain connection of the regulating transistor; and a fixed value voltage source having an output terminal and an input terminal and provides an output voltage on the output terminal that is a fixed value above an input voltage on the input terminal, wherein the input terminal is connected to a gate of the output transistor and the output terminal is connected to the inverting input of the second differential amplifier.

13. The circuit arrangement of claim 12, wherein the voltage divider circuit comprises a first resistor across the first and second terminals and a second resistor across the second and third terminals, wherein the first resistor is about 300 ohms and the second resistor is about 1200 ohms.

14. The circuit arrangement of claim 12, wherein the bandgap voltage is about 1.2 volts.

15. The circuit arrangement of claim 12, wherein the regulated output voltage is about 1.5 volts and the supply voltage is about 2.5 volts.

16. The circuit arrangement of claim 12, wherein a withstand voltage of the output transistor is 1.5 volts and a withstand voltage of the regulating transistor is 2.5 volts.

17. The circuit arrangement of claim 12, wherein a withstand voltage of the output transistor less than a withstand voltage of the regulating transistor.

18. The circuit arrangement of claim 12, wherein the output transistor is an NMOS transistor and the regulating transistor is a PMOS transistor.

19. The circuit arrangement of claim 12, further comprising a resistor having a first terminal connected to the source connection of the output transistor and a second terminal connected to the third terminal of the voltage divider circuit and further comprising a capacitor having a first terminal connected to the source connection of the output transistor and a second terminal connected to the third terminal of the voltage divider circuit.

* * * * *